United States Patent [19]

Luithlen

[11] 4,252,337

[45] Feb. 24, 1981

[54] SKI BRAKE

[75] Inventor: Heinz Luithlen, Rutesheim, Fed. Rep. of Germany

[73] Assignee: Vereinigte Baubeschlagfabriken Gretsch & Co. GmbH, Fed. Rep. of Germany

[21] Appl. No.: 3,024

[22] Filed: Jan. 12, 1979

[30] Foreign Application Priority Data

Jan. 14, 1978 [DE] Fed. Rep. of Germany ..... 2801615

[51] Int. Cl.[3] ..... A63C 7/10

[52] U.S. Cl. ..... 280/605; 280/814

[58] Field of Search ..... 280/605, 604, 11.37 A, 280/11.37 K, 814

[56] References Cited

U.S. PATENT DOCUMENTS

| | | | |
|---|---|---|---|
| 4,036,509 | 7/1977 | Schwarz | 280/605 |
| 4,062,553 | 12/1977 | Riedel | 280/11.37 A |

FOREIGN PATENT DOCUMENTS

| | | | |
|---|---|---|---|
| 2412623 | 11/1975 | Fed. Rep. of Germany | 280/605 |
| 2462411 | 1/1977 | Fed. Rep. of Germany | 280/605 |
| 2624231 | 12/1977 | Fed. Rep. of Germany | 280/11.37 A |
| 2757107 | 10/1978 | Fed. Rep. of Germany | 280/11.37 A |

*Primary Examiner*—David M. Mitchell

*Attorney, Agent, or Firm*—Craig & Antonelli

[57] ABSTRACT

Ski brake apparatus is provided which includes ski brakes designed to accommodate holding or latching together of the skis when in a stored condition by means of the ski brake structure. In particularly preferred embodiments, pivotally movable brake claws of the brakes at one ski include an opening engageable with the pivot axle for the brake at the other ski. The opening is configured so as to require a pressing together of the bottoms of the skis against their elastic tension to permit insertion and snap-locking of the one ski brake end portion with the pivot axle or pin of the other ski brake to lock the skis together.

14 Claims, 2 Drawing Figures

SKI BRAKE

BACKGROUND AND SUMMARY OF THE INVENTION

The invention relates to a ski brake with an arcuate member that is rotatably borne about at least one fixed transverse axis relative to the ski, which on one side of the transverse axis presents brake arm means, preferably two brake arms, extending next to the ski. On the opposite side of the transverse axis a pedal is provided that comes into engagement with the underside of the skier's boot, whereby the rotatable bearing is constituted by pivot pins running in the direction of the transverse axis and connecting the brake arms with the pedal. The arcuate member is resiliently tensioned in its storage position in such a way that when the ski boot is not set in, the arcuate member is swung into the brake position in which the brake arms project from the underside of the ski and the pedal projects from the upper side of the ski, and further in such a way that when the ski boot is set on the pedal, the arcuate member will be swung into an inoperative position against the force of the resilient means, in which position the brake arms will be next to or above the ski and the pedal will lie under the ski boot fixed in the ski binding.

For holding skis together for transportation, it is already known that measures can be provided on ski brakes which make it possible to hold the skis detachably connected together by means of the brakes, i.e. without straps, bands etc.

In a known ski brake (German OS No. 2,462,411) there is provision of recesses for this on the inner edges of the brake arms of the respective skis, which when the underside of a pair of skis are laid together engage over the outer edges of the brake arms of the other ski. In this known arrangement it is a disadvantage that the brake arms which have the recesses have to be spread so that they can engage over the brake arms of the other ski, and when this is unskillfully done the functioning capability of the ski brake can be impaired.

In another known ski brake (German OS No. 2,462,390) there are tips or cams on the brake arm, with which grooves on the other ski are associated. Such a ski brake is only suited for holding the skis together if the brake claws on the arms which present the cams are held so as to be rotatably movable. In this known arrangement it is a drawback particularly that there has to be rotationally movable holding of the claws so that they may be turned unintentionally and this would have a bad effect on the functioning of the brake.

The problem approached and solved by the present invention includes development of a ski brake of the mentioned type in such a way that holding the skis together will be possible, with the simplest means that could not have a bad effect on the ski brake.

To solve the problem, the invention provides that on the upper side of the brake arms of at least one arcuate member there will be hook-like tips with an opening toward the pivot pin of the arcuate member, whereof, when the undersides of a pair of skis are laid together with use of the elastic tension of the skis, at least one tip of the brake arm of one arcuate member will engage over the pivot pin of the other arcuate member.

In order not to have to see to it that the arcuate member that presents the tip will come to lie over the other arcuate member in putting the skis together, according to a specially preferred form of embodiment, hook-like tips are provided on the brake arms of both arcuate members. Thus the skis can be joined in any position, and if in some situations a tip were to be broken off, it would still be possible to put the skis together.

To ensure that the skis hold together in any carrying position, according to another advantageous development of the invention, the depth of the tip is greater than the half diameter of the pivot pin, whereby there is a kind of undercutting that secures the joining of the skis.

To attain the effect that in joining the skis together the brake cam of one arcuate member will come to lie over that of the other arcuate member, the tips, on the side opposite the opening, are provided with a slant rising toward the pivot pin, by means of which slant the brake arms of one arcuate member will be raised over the pivot pin of the other arcuate member.

In an embodiment that is especially preferred because it is inexpensive, the tips are molded on the plastic brake claws with which most ski brakes are provided. It is also contemplated however to make the tips as sheet metal or bending parts on the brake arms, or to form the tips by stamping from the brake arms, according to other preferred embodiments.

The width of the tips may vary in the wide region of the brake arms or claws, but it is especially advantageous if at least in the region that engages over the pivot pin they are narrower than the distance between the side edge of the ski and the brake arm or the inner edge of the claw, so that even if for example only one tip engages the pivot pin, secure holding together of the skis will still be ensured.

Since the thicknesses of skis are very different and a device for holding skis together should take account of this situation, according to another characteristic of particularly preferred embodiments of the invention the position of the tips on the upper side of the brake arms is so selected that the tips of one arcuate member can engage over the pivot pin of the other arcuate member when the undersides of the skis are applied to each other only after a partial pressing together of the skis.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 2:
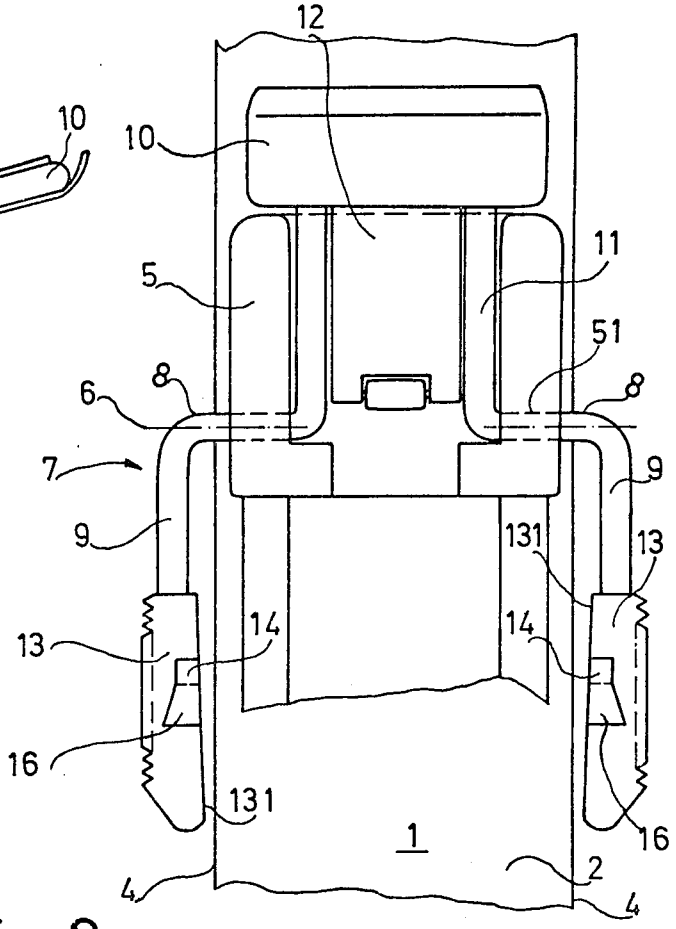
FIG. 2 is a schematic top view of one of the ski brakes shown in FIG. 1.
Figure 1:
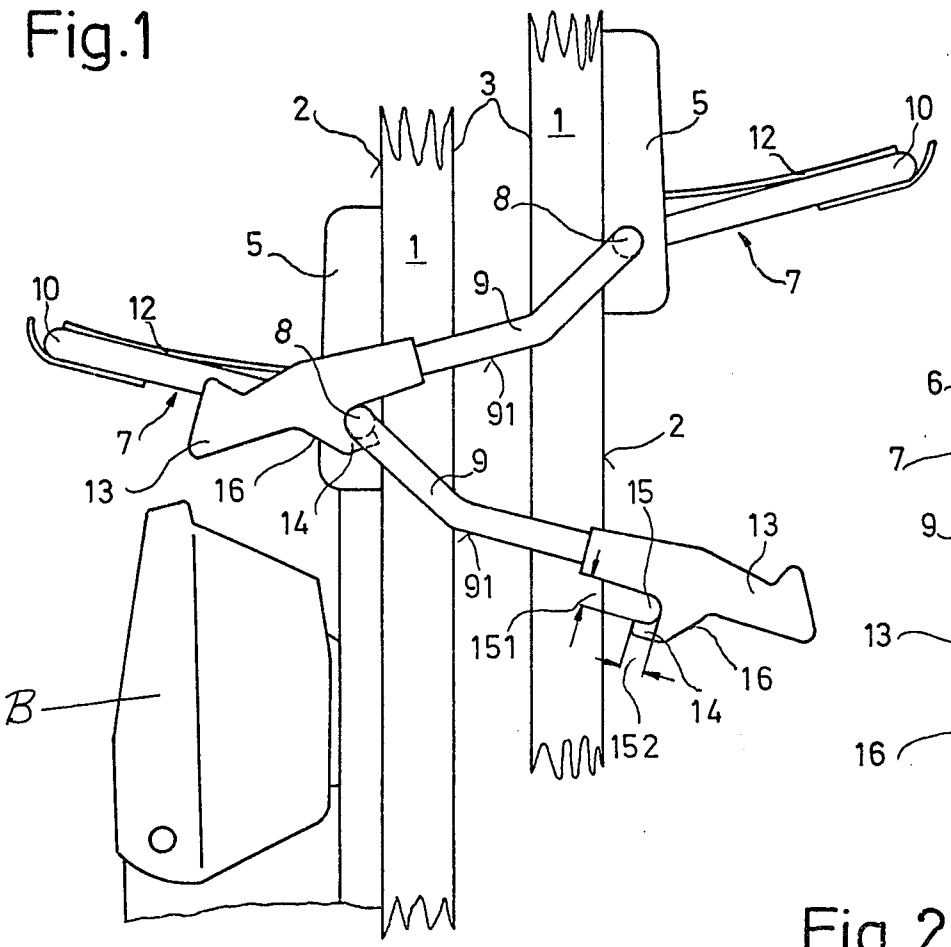
FIG. 1 is a schematic lateral view of ski brake devices for holding skis together constructed in accordance with a preferred embodiment of the invention.

According to FIGS. 1 and 2, a plate 5 is fixed on the upper side 2 of ski 1 in the region of the binding B, such as by mounting to the end thereof, as shown. Plate 5 laterally supports two bearings 51 with axis 6 that runs crosswise to ski 1. Pivot pins 8 of a ski brake consisting of an arcuate member 7 are so borne in the bearings 51 that they can only rotate about transverse axis 6. From the pins 8, brake arms 9 extend on either side of ski 1, which in the braking position as shown in FIG. 2, project from underside 3 of the ski at a more or less wide angle. In the direction opposite to that of brake arms 9, two rods 11 extend from pivot pins 8, which together with a part that connects the two constitute the pedal 10.

Brake arm 9, pivot pin 8 and rods 11 are bent, out of a single piece of rod material. Advantageously however the two rods 11 can be integrally connected with each other via pedal 10 according to certain preferred embodiments.

At the end of pedal 10 which is turned away from pivot pin 8, there are three leaf springs forming a bending spring 12, fastened in such a way that in the brake position of FIG. 1 they are bent down out of the plane of pedal 10. The ends of the leaf springs can be bolted or riveted to pedal 10, for example. It is of decisive importance in particularly preferred embodiments, that the moments created by bending spring 12 can be transmitted to pedal 10 and thereby to brake arms 9. However, it is also contemplated to make the resilient means as torsion rods, whereby then rods 11 would present angular bends running in the same direction as bending spring 12.

Brake arms 9 are provided with claws 13 at their ends which are preferably plastic, for example, molded onto the brake arms. Claws 13 are intended to enhance braking resistance and to protect against injury. According to the invention, on the upper side 91 of brake arms 9 there are tips 14 with an opening 15 toward pivot pin 8. In the illustrated embodiment, these tips 14 are molded on with the brake claws 13. Tips 14 are disposed in the transverse direction of the ski, in such a way that they terminate flush with inside 131 of brake claw 13. The internal width 151 of opening 15 is here of such size that it corresponds at least to the diameter of pivot pin 8, while depth 152 of opening 15 is larger than half the diameter of pin 8.

Joining of the skis is effected as follows.

Oppositely facing skis 1 are laid on each other with their undersides 3. Since in this situation the ski boot has been removed from the binding, the ski brakes assume the position shown in FIG. 1, i.e., brake arms 9 extend over the ski underside 3. When the skis are applied to each other, slanted parts 16 of tips 14 of brake arms 9 of the righthand brake shown in FIG. 1 slide over pivot pin 8 of the lefthand brake (FIG. 1), whereby the position of the ski brakes with reference to each other is aimed at their snapping together. Since the undersides of the skis in the tip and end zones already are applied to each other because of their pretensioning, these are now further pressed together, partly overcoming the tension, at least to the extent that the ends of tips 14 can slide over pivot pins 8. In this situation therefore, pins 8 are disposed before openings 15 of tips 14. If now one stops pressing the skis together, the mutual separation of the undersides of the skis will become greater again because of the pretensioning, and pins 8 will run into opening 15 of tip 14. Pins 8 are thus engaged by tips 14, whereby the skis will be elastically locked together, still with partial tension caused by the skis. In a corresponding reverse sequence, the skis can be snapped apart again.

Secure holding together of the skis in any position is ensured, especially in the longitudinal direction. Even if in the held-together state according to FIG. 1 only the lefthand or righthand ski is held and lifted, because of the intrinsic weight of the righthand or lefthand ski, pivot pin 8 of the left ski will be pressed more strongly into opeing 15 of tip 14, and hence a still stronger holding effect will be produced.

Of particular importance for preferred embodiments of the subject of the invention is the exploitation of the elastic tension of the skis, for holding them together by means of the ski brakes.

While I have shown and described one embodiment in accordance with the present invention, it is understood that the same is not limited thereto, but is susceptible of numerous changes and modifications as known to those skilled in the art and I therefore do not wish to be limited to the details shown and described herein but intend to cover all such changes and modifications as are encompassed by the scope of the appended claims.

I claim:

1. Ski brake apparatus for use with skis comprising:

bearing means for fixedly attaching to a ski;

brake arm means pivotally connected to said bearing means, by a pivotable connection, about a transverse axis for applying a braking force to a ski, said brake arm means including brake arms, each disposed at a position laterally spaced, respectively from each side of said ski and extending in a first direction from said transverse axis, and a boot engaging pedal extending in a second, opposite direction from said transverse axis, said brake arm means being shiftable about said transverse axis between an in-use skiing position substantially in alignment with a plane including the upper surface of the ski and an in-use braking position extending outwardly from said plane; and resilient means for biasing said brake arm means toward said braking position;

wherein said brake arms comprise means for enabling said brake arms to interlock with brake arm means of another like, oppositely facing ski brake apparatus under action of forces biasing said ski brake apparatus apart, and wherein said means for enabling interlocking of like ski brake apparatus comprises an arcuate formation on each brake arm that is open in said second direction toward said boot engaging pedal for engaging a substantially laterally extending portion of said brake arm means of said like ski brake apparatus.

2. Ski brake apparatus according to claim 1, wherein said arcuate formations are formed by hook-like tips on the brake arms, and the pivotal connection of said brake arm means is formed by pivot pin means extending transversely from said brake arms.

3. Ski brake apparatus according to claim 2, wherein said hook-like tips define an opening that has an inner width corresponding to at least the diameter of the pivot pin means.

4. Ski brake apparatus according to claim 3, wherein said opening has a depth greater than half the diameter of the pivot pin means.

5. Ski brake apparatus according to claim 3, wherein the hook-like tip has a slant directed toward the opening on a side opposite thereto.

6. Ski brake apparatus according to claim 1, or 5, wherein each brake arm is provided with a plastic brake claw.

7. Ski brake apparatus according to claim 2, wherein said hook-like tips have a slant directed toward a respective opening on a side that is opposite thereto.

8. Ski brake apparatus according to claim 7, wherein the brake arms are provided with plastic brake claws molded together with the tips.

9. Ski brake apparatus according to claim 7, wherein the pivot pin means are in the form of round steel wire formed integrally with said brake arms.

10. Ski combination including a pair of skis of the type having camber and ski brake apparatus mounted to each ski of said pair, wherein said ski brake apparatus comprises:

bearing means for fixedly attaching to a ski;

brake arm means pivotally connected to said bearing means, by a pivotable connection, about a transverse axis for applying a braking force to a ski, said brake arm means including brake arms, each disposed at a position laterally spaced, respectively, from each side of said ski and extending in at a first direction from said transverse axis and a boot engaging pedal extending in a second, opposite direction from said transverse axis, said brake arm means being shiftable about said transverse axis between an in-use skiing position substantially in alignment with a plane including the upper surface of the ski and an in-use braking position extending outwardly from said plane; and resilient means for biasing said brake arm means toward said braking position;

wherein said brake arms comprise means for enabling said brake arms to interlock with brake arm means of another like, oppositely facing ski brake apparatus under action of forces biasing said ski brake apparatus apart, and wherein said means for enabling interlocking of like ski brake apparatus comprises an arcuate formation on each brake arm that is open in said second direction toward said boot engaging pedal for engaging a substantially laterally extending portion of said brake arm means of said like ski brake apparatus.

11. Ski combination according to claim 10, wherein said ski brake apparatus are mounted to ski shoe bindings fastened to said skis.

12. Ski combination according to claim 10, wherein said arcuate formations are formed by hook-like tips on the brake arms, and said pivotal connection is formed by pivot pin means extending transversely from said brake arms.

13. Ski brake apparatus according to claim 12, wherein the width of the hook-like tips at least in the region of their engagement over respective pivot pin means is less than a distance between a side edge of the ski and the brake arms.

14. Ski combination according to claim 13, wherein the hook-like tips are positioned on the upper side of the brake arms such that the tip of one brake arm of the ski brake apparatus can engage over the pivot pin means of a brake arm of said like, oppositely facing ski brake apparatus, when the undersides of the skis of said pair are laid on each other, only after a partial pressing together of the skis so as to reduce their camber.

* * * * *